US012467210B2

(12) United States Patent
Buerger et al.

(10) Patent No.: US 12,467,210 B2
(45) Date of Patent: Nov. 11, 2025

(54) TRACK MAINTENANCE MACHINE AND METHOD FOR STABILIZING A BALLAST BED

(71) Applicant: PLASSER & THEURER EXPORT VON BAHNBAUMASCHINEN GESELLSCHAFT M.B.H., Vienna (AT)

(72) Inventors: Martin Buerger, Linz (AT); Gerald Zauner, Wilhering (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 888 days.

(21) Appl. No.: 17/436,814

(22) PCT Filed: Feb. 6, 2020

(86) PCT No.: PCT/EP2020/052918
§ 371 (c)(1),
(2) Date: Sep. 7, 2021

(87) PCT Pub. No.: WO2020/177967
PCT Pub. Date: Sep. 10, 2020

(65) Prior Publication Data

US 2022/0170213 A1 Jun. 2, 2022

(30) Foreign Application Priority Data

Mar. 6, 2019 (AT) ..... A 83/2019

(51) Int. Cl.
*E01B 27/20* (2006.01)
*E01B 27/10* (2006.01)
(Continued)

(52) U.S. Cl.
CPC ..... *E01B 27/20* (2013.01); *E01B 27/107* (2013.01); *E01B 27/17* (2013.01); *E01B 29/04* (2013.01)

(58) Field of Classification Search
CPC ..... E01B 27/20; E01B 27/107; E01B 27/10; E01B 27/17; E01B 27/00; E01B 27/02;
(Continued)

(56) References Cited

U.S. PATENT DOCUMENTS 4,355,687 A * 10/1982 Theurer ..... E01B 27/026 171/16
4,858,696 A * 8/1989 Theurer ..... E01B 27/10 171/16
(Continued)

FOREIGN PATENT DOCUMENTS

CN 107190597 A 9/2017
DE 3223350 A1 1/1984
(Continued)

*Primary Examiner* — S. Joseph Morano
*Assistant Examiner* — Heaven R Buffington
(74) *Attorney, Agent, or Firm* — Laurence A. Greenberg; Werner H. Stemer; Ralph E. Locher

(57) ABSTRACT

A track maintenance machine for stabilizing a ballast bed of a track after a tamping operation, includes a machine frame mobile on on-track undercarriages and a stabilizing unit which has rollers for gripping a track grid and a vibration generator for actuating the track grid with a vibration. A clearing device is disposed at both longitudinal sides of the track maintenance machine in front of the stabilizing unit with regard to a working direction. Each respective clearing device includes a clearing tool which can be lowered into the ballast bed to remove ballast from a respective sleeper-end region. Thus, preconditions are created by using the stabilizing unit to achieve an increased lowering of the track grid
(Continued)

as compared to a normal stabilizing procedure. A method for operating a track maintenance machine is also provided.

10 Claims, 2 Drawing Sheets

(51) Int. Cl.
*E01B 27/17* (2006.01)
*E01B 29/04* (2006.01)

(58) Field of Classification Search
CPC ..... E01B 27/023; E01B 27/26; E01B 27/105; E01B 27/12; E01B 27/16; E01B 29/05; E01B 29/2904; E01B 29/04
USPC ..... 104/2
See application file for complete search history.

(56) References Cited

U.S. PATENT DOCUMENTS

| | | | | |
|---|---|---|---|---|
| 4,881,467 | A | 11/1989 | Theurer | |
| 4,953,467 | A * | 9/1990 | Theurer | E01B 35/04 104/12 |
| 5,172,637 | A | 12/1992 | Theurer et al. | |
| 6,021,717 | A | 2/2000 | Theurer | |
| 10,260,203 | B2 | 4/2019 | Lintz | |

FOREIGN PATENT DOCUMENTS

| | | | |
|---|---|---|---|
| DE | 3819717 | A1 | 3/1989 |
| EP | 0497232 | A2 | 8/1992 |
| EP | 0887464 | A1 | 12/1998 |
| WO | 2006056215 | A1 | 6/2006 |
| WO | 2016023609 | A1 | 2/2016 |

* cited by examiner

TRACK MAINTENANCE MACHINE AND METHOD FOR STABILIZING A BALLAST BED

BACKGROUND OF THE INVENTION

Field of the Invention

The invention relates to a track maintenance machine for stabilizing a ballast bed of a track after a tamping operation, including a machine frame mobile on on-track undercarriages and a stabilizing unit which has rollers for gripping a track grid and a vibration generator for actuating the track grid with a vibration. In addition, the invention relates to a method for operating the track maintenance machine.

Prior Art

A track maintenance machine of the specified type is known from WO 2006/056215 A1. This kind of machine is usually called a dynamic track stabilizer (DTS). The disclosed track maintenance machine comprises a stabilizing unit by means of which a track is stabilized following a tamping operation. In this, it is scheduled that the track grid is initially lifted beyond a final target position and tamped. By means of the following stabilizing procedure, the track grid is to be lowered to the desired target position. Because of non-foreseeable circumstances, it may happen that the overlift carried out during the tamping operation turns out to be too great. Then, the subsequent lowering by means of a regular stabilizing procedure is not sufficient to attain the target position. In these cases, a manual after-treatment of the track bed is required in order to lower the track grid to the desired level.

SUMMARY OF THE INVENTION

It is the object of the invention to improve a track maintenance machine of the type mentioned at the beginning to counteract in a simple manner an undesired overlift of the track. It is additionally an object of the invention to indicate a corresponding method for operating the track maintenance machine.

According to the invention, these objects are achieved by way of the features described below. Dependent claims indicate advantageous embodiments of the invention.

In this, it is provided that in front of the stabilizing unit with regard to a working direction, a respective clearing device is arranged at both longitudinal sides of the track maintenance machine, and that the respective clearing device comprises a clearing tool, lowerable into the ballast bed, to remove ballast from a respective sleeper-end region. By actuation of the clearing devices, furrows are created in the ballast bed at either side of the track grid which extend parallel to the track axis and expose the sleeper end surfaces. In a track section which has been treated in this way, the resistance of the track grid to lateral displacement is reduced, as a result of which an increased kinetic energy is transmitted by means of the stabilizing unit to the track grid. In addition, free space is created in the sleeper-end regions for that ballast which migrates laterally from underneath the sleepers during a stabilizing procedure. Thus, the prerequisites are provided to achieve by means of the stabilizing unit a greater lowering of the track grid as compared to a regular stabilizing procedure.

In a simple embodiment of the respective clearing device, it is envisaged that the respective clearing tool is pivotable relative to a mount by means of an adjustment drive. In this manner, the respective clearing tool can be lowered in an automatized way into the associated sleeper-end region.

A further improvement provides that the respective clearing tool comprises a circulating clearing chain. Such a clearing tool is especially robust, wherein individual chain links can be changed in a simple manner in case of progressing wear.

In this, it is favourable if the respective clearing chain includes conveying means to convey ballast to an upper discharging point, and if a storage device or a further conveying device is arranged underneath the respective discharging point. Instead of merely shoving the ballast to the side, the ballast is taken up. Expediently, after the track grid has been lowered, the picked-up ballast is re-introduced into the sleeper-end regions.

In order to enable an extensive automatizing of the treatment procedures, it is advantageous if the track maintenance machine includes a measuring system by means of which a lowering of the track grid during a stabilizing procedure can be measured. Then, the stabilizing unit is controlled in dependence on the currently recorded track position. For example, the vibration frequency is increased in order to improve the flow behaviour of the ballast and thus accelerate the lowering process of the track grid.

An enhancement of the track maintenance machine according to the invention provides that a further machine unit is coupled in front of the machine frame with regard to the working direction, and that a lifting unit and a tamping unit are arranged on the further machine unit. Thus, a combined track maintenance machine exists by means of which tamping and stabilizing is carried out in one working pass. The invention is particularly effective here since there is an immediate reaction to an undesired overlift during tamping without interruption of the workflow.

In this, it is advantageous if a further measuring system for recording a track level is coupled to the further machine unit. For example, a measuring trolley is arranged in an area rearward of the tamping unit in order to record the track position resulting after a tamping procedure. In this way, an undesired overlift is automatically detected.

In a further development, it is provided that measuring results of the further measuring system are fed to an evaluation device, and that the evaluation device is coupled to a control device for controlling the clearing devices. This raises the degree of automatization, so that the track maintenance machine can be operated largely without any intervention by operating personnel.

In the method according to the invention for operating the track maintenance machine, the two clearing devices are brought in an activation procedure from an inoperative position into a working position, wherein ballast is removed from the sleeper-end regions by means of the clearing devices during forward travel of the machine, and wherein the track grid is set in vibration by means of the stabilizing unit and charged with a vertical load. This method enables a lowering of the track grid by means of the stabilizing unit beyond a normal measure in order to compensate undesired overlifts during a tamping procedure.

For automatization of the method, it is useful if a vertical position of the track after a lifting- and tamping procedure is recorded, and if the clearing devices are activated by means of a control device if a prescribed vertical position is exceeded. During this, a depth of immersion of the clearing devices into the respective sleeper-end region can take place in dependence on the detected vertical position. In this, the required lowering of the track grid determines the quantity of the ballast to be cleared. It can also be useful to record a separate vertical level for each rail, and to control the clearing devices differently. For example, on a side where less lowering is specified, a smaller depth of immersion of the corresponding clearing device is set.

BRIEF DESCRIPTION OF THE SEVERAL VIEWS OF THE DRAWING

The invention will be described below by way of example with reference to the accompanying drawings. There is shown in a schematic manner in.

DETAILED DESCRIPTION OF THE INVENTION

Figure 1:
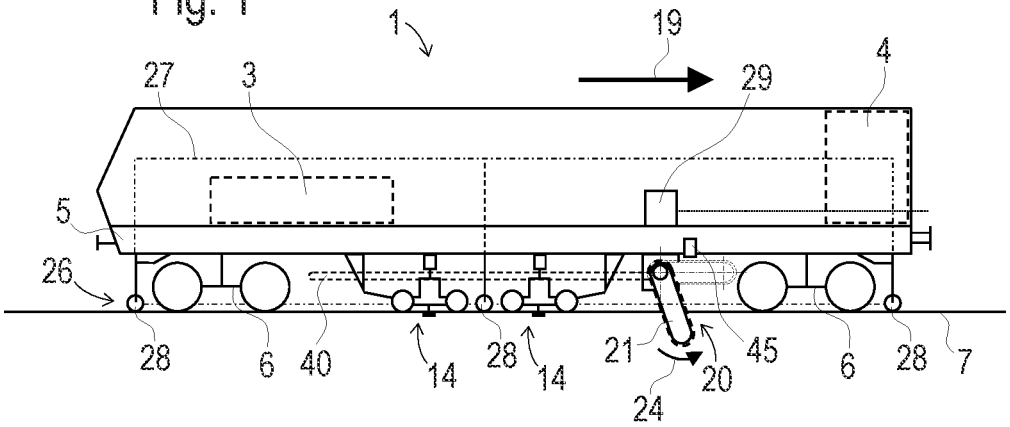
FIG. 1 a track maintenance machine with clearing devices and stabilizing units FIG. 2 a track maintenance machine with lifting unit and tamping unit FIG. 3 a cross-section of a track with clearing devices and stabilizing unit FIG. 4 stabilizing units and track in a top view

The track maintenance machine according to the invention is designed either as a stand-alone stabilizing machine 1 (FIG. 1) or as a combined machine with a tamping machine 2 (FIG. 2) and a stabilizing machine 1 coupled thereto. In the case of a stand-alone stabilizing machine 1, the machine has its own drive 3 and its own driver's stand 4. The track maintenance machine has a machine frame 5 which is mobile on on-track undercarriages 6 on a track 7.

The track 7 is a ballasted track with a track grid 9 supported in a ballast bed 8. The track grid 9 consists of sleepers 10 and rails 11 fastened thereon. So-called sleeper cribs 12 are formed between the sleepers 10, and so-called sleeper-end regions 13 are located adjoining the front sides of the sleepers 10. Consolidated ballast in the sleeper cribs 12 and in the sleeper-end region 13 contributes to the track grid 9 remaining in position when loaded. Besides the friction of the ballast at the longitudinal sides of the sleepers, it is particularly the degree of consolidation of the ballast in the sleeper-end regions 13 that determines the so-called resistance to transverse displacement of the track 7.

The track maintenance machine shown in FIG. 1 comprises two stabilizing units 14 having rollers 15 for gripping the track grid 9. In a simple embodiment, only one stabilizing unit 14 is arranged. In operation, the respective stabilizing unit 14 is set in a vibration 17 by means of a vibration generator 16. Usually, a horizontal vibration in the transverse direction of the track is transmitted to the track grid 9 via the rollers 15. In addition, the track grid 9 can be charged with a vertical load by means of hydraulic cylinders 18 in order to enhance the effect of a stabilizing procedure.

In front of the stabilizing units 14, with regard to a working direction 19, a clearing device 20 is arranged on each longitudinal side of the track maintenance machine. The respective clearing device 20 comprises a clearing tool 21 which can be lowered into the ballast bed 8 in the assigned sleeper-end region 13. The respective clearing tool 21 is designed, for example, in a sword-like shape with a clearing chain 23 circulating in a working plane 22. It is useful if the working plane 22 is oriented approximately vertically and parallel to the working direction 19. The circulation direction 24 of the respective clearing chain 23 is chosen so that the ballast is cleared forwardly and upwardly and deposited laterally. In this manner, a furrow 25 is created in each sleeper-end region 13 in which the respective front sides of the sleepers 10 are exposed. With a working plane 22 being tilted slightly to the outside, the ballast is deposited more at the outside of the respective sleeper-end region 13.

The track maintenance machine comprises a measuring system 26 by means of which a lowering of the track grid 9 during a stabilizing procedure can be measured. The measuring system 26 comprises, for example, measuring chords 27 and measuring trolleys 28. The measuring trolleys 28 are pressed with telescopic axles to the rails 11 and follow the course of the track. The measuring chords 27 serve as reference system for the position of the measuring trolleys 28 relative to one another. Virtual measuring chords 27 and optical measuring devices could also be used.

Measuring results of the measuring system 26 are fed to a control device 29 by means of which the stabilizing units 14 and the hydraulic cylinders 18 are actuated. For example, the vibration frequency and/or the vertical load are changed to influence the lowering of the track grid 9. If the frequency rises above 35 Hz in particular, the ballast shows a flow behaviour which causes an intensified shifting of the ballast stones. Ideally, a vibration frequency of about 50 Hz is chosen to achieve a high mobility of the ballast stones. In the present invention, an increased vibration frequency has the effect that more ballast stones migrate from areas under the sleepers 10 into the free space formed by the furrows 25.

Figure 2:
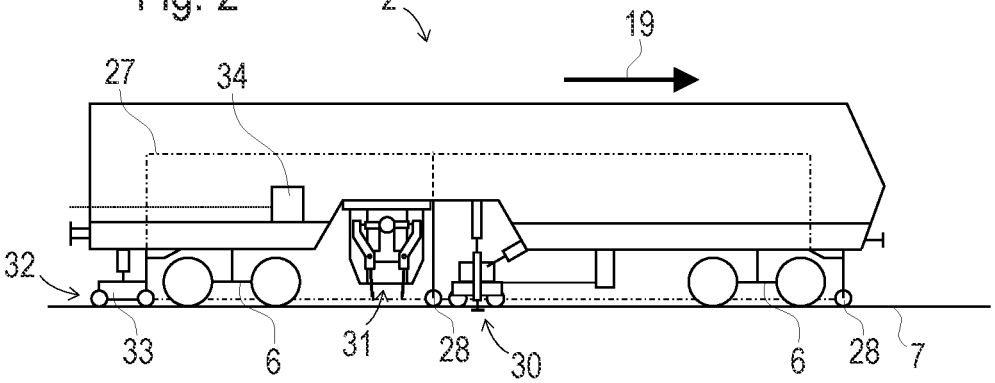

The machine unit shown in FIG. 2 comprises a lifting unit 30, a tamping unit 31 and a further measuring system 32. In the case of a combined machine, this machine unit is coupled at the front of the stabilizing machine 1. During a tamping procedure, the track grid 9 is lifted by means of the lifting unit 30 and fixed in its position through tamping by means of the tamping unit 31. In this, the further measuring system 32 comprises measuring chords 27 to compare a current lifting value to a prescribed target value. Normally, the track grid 9 is lifted beyond a target position of the track 7 in order to subsequently carry out a lowering into the target position by means of the stabilization machine 1.

Favourably, the further measuring system 32 additionally comprises a measuring trolley 33 for check-measuring the lifted track 7. With this, an impermissible overlift is detected immediately. For example, the measuring results are compared to a prescribed vertical position in an evaluation device 34. The evaluation device 34 is coupled to the control device 29 for actuation of the clearing devices 20. In this manner, the clearing devices 20 can be activated automatically as soon as an impermissible overlift is detected in the evaluation device 34.

Figure 3:
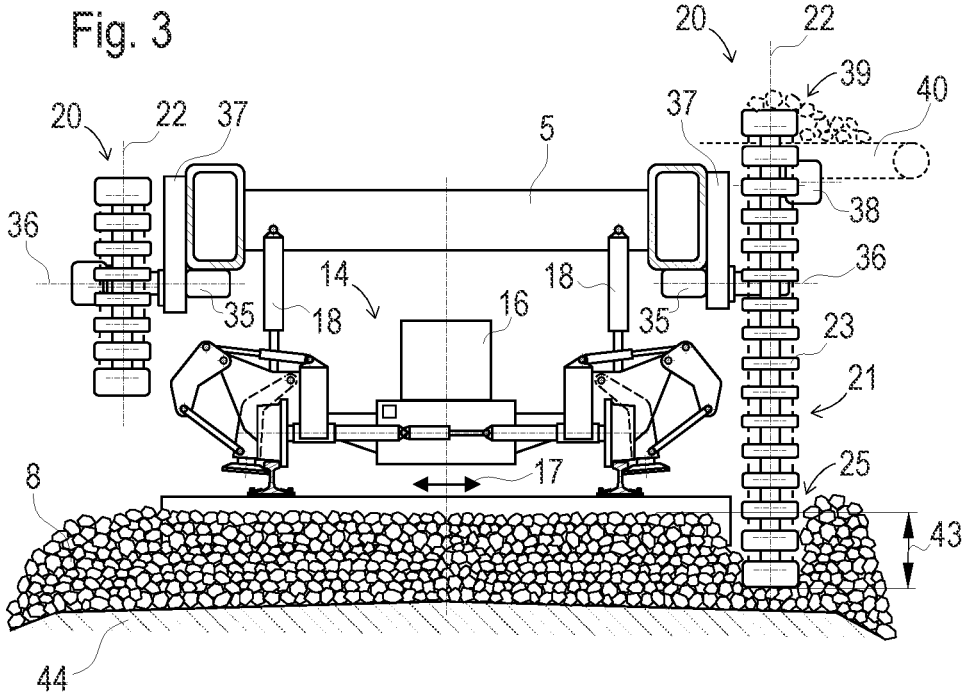

Shown at the left side in FIG. 3 is a clearing device 20 in the inoperative position. The clearing device 20 at the right side is in the working position. For changing the position, the respective clearing tool 21 is pivotable about a pivot axis 36 relative to a mount 37 by means of an adjustment drive 35. In a simple embodiment, the two clearing devices 20 are coupled by a common mount 37 and a common pivoting device. In addition, it may be useful to make the position of the clearing tools 21 adjustable in lateral direction in order to adjust the distance to the sleeper end surfaces. To that end, for example, the respective clearing tool 21 is connected to the mount 37 via a guide and an displacement drive.

In the embodiment shown having a clearing chain 23, a chain drive 38 is arranged. Optionally, the chain links are equipped with conveying means by means of which the ballast is conveyed from the respective sleeper-end region 13 to an upper discharge point 39. Here, a storage- or conveying device 40 is arranged under the respective discharge point 39. With this further development of the invention, the possibility is created to reintroduce the ballast into the respective sleeper-end region 13 again after a lowering of the track. In addition, it is useful if—after track lowering and, optionally, a reintroduction of the ballast have taken place—an after-treatment of the ballast bed cross-section is carried out. To that end, the track maintenance machine comprises, for example, adjustable shoulder ploughs at both longitudinal sides behind the stabilizing unit 14. A separate shoulder profiling machine may also be used.

Figure 4:
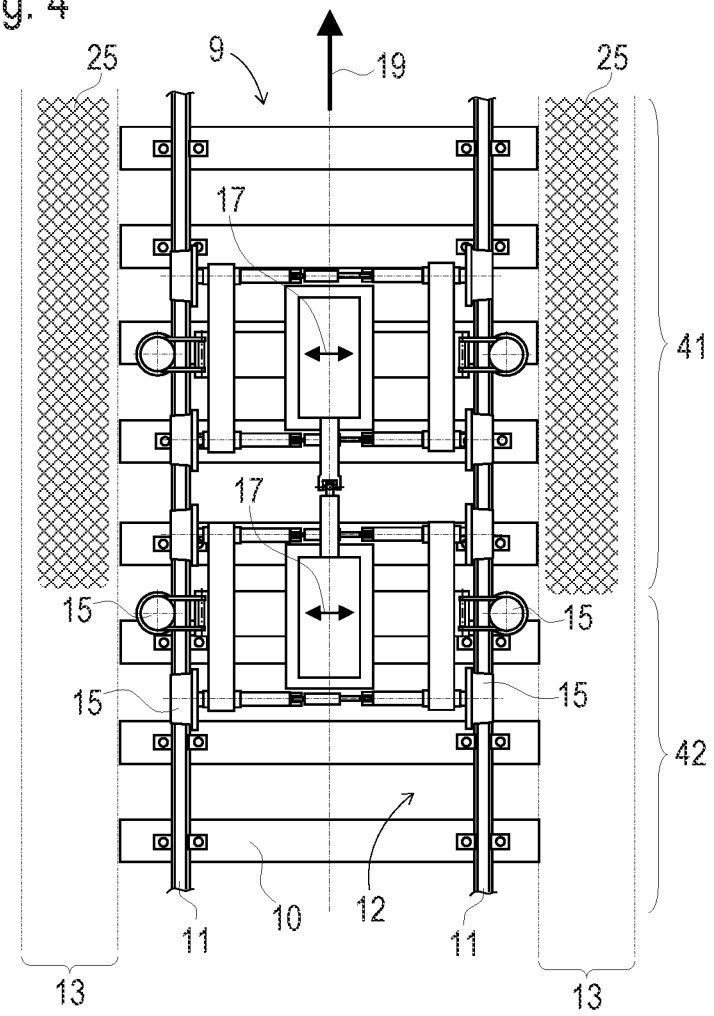

The representation in FIG. 4 shows a first zone 41 with furrows 25 at both sides, and a second zone 42 without furrows 25. According to the invention, with activity of the stabilizing units 14 being consistent, the lowering of the track grid 9 in the first zone 41 is more pronounced than in the second zone 42. During this, a penetration depth 43 of the clearing tools 21 determines the depth of the emerging furrows 25. In order to ensure that the entire sleeper front sides are cleared, a penetration depth 43 has to be stipulated which reaches distinctly below the lower edges of the sleepers. During this, however, care must be taken that a formation layer 44 located below the ballast bed 8 is not damaged under any circumstances.

Optionally, an optical sensor 45 is arranged which records the position of the clearing tools 21 with regard to the track 7 and is coupled to the control device 29. With this, the possibility is created to automatically adjust—beside the penetration depth 43—also the lateral distance of the clearing tools 21 to the sleepers 10. In addition, the sensor can be used for recognizing obstructions in order to carry out an automatic evasion action by the clearing tools 21.

The invention claimed is:

1. A track maintenance machine for stabilizing a ballast bed of a track after a tamping operation, the track maintenance machine comprising:

on-track undercarriages;

a machine frame mobile on said on-track undercarriages;

a stabilizing unit having rollers for gripping a track grid disposed on sleepers on a ballast bed defining sleeper-end regions;

a vibration generator for actuating the track grid with a vibration; and clearing devices each disposed at a respective longitudinal side of the track maintenance machine, said clearing devices disposed in front of said stabilizing unit relative to a working direction of the track maintenance machine, each of said clearing devices including a respective clearing tool lowerable into the ballast bed for removing ballast from a respective one of the sleeper-end regions, and said clearing devices creating furrows extending parallel to an axis of the track and exposing end surfaces of the sleepers, said exposed end surfaces reducing resistance of the track grid to lateral displacement.

2. The track maintenance machine according to claim 1, which further comprises mounts, and adjustment drives each pivoting a respective one of said clearing tools relative to a respective one of said mounts.

3. The track maintenance machine according to claim 1, wherein each of said clearing tools includes a respective circulating clearing chain.

4. The track maintenance machine according to claim 3, wherein each of said clearing chains includes a respective conveyor for conveying ballast to a respective upper discharging point, and storage devices or further conveyors are each disposed underneath a respective one of the discharging points.

5. The track maintenance machine according to claim 1, which further comprises a measuring system for measuring a lowering of the track grid during a stabilizing procedure.

6. The track maintenance machine according to claim 1, which further comprises a further machine unit coupled in front of said machine frame relative to the working direction of the track maintenance machine, and a lifting unit and a tamping unit disposed on said further machine unit.

7. The track maintenance machine according to claim 6, which further comprises a further measuring system coupled to said further machine unit for recording a track level.

8. The track maintenance machine according to claim 7, which further comprises an evaluation device receiving measuring results of said further measuring system, and a control device coupled to said evaluation device for controlling said clearing devices.

9. A method for operating a track maintenance machine, the method comprising:

providing a track maintenance machine according to claim 1; and carrying out an activation procedure by:

bringing said clearing devices from an inoperative position into a working position, removing ballast from the sleeper-end regions by using the clearing devices during a forward travel of the track maintenance machine, reducing resistance of the track grid to lateral displacement by using said clearing devices to create furrows extending parallel to an axis of the track and exposing end surfaces of the sleepers, setting the track grid in vibration by using the stabilizing unit, and charging the track grid with a vertical load.

10. The method according to claim 9, which further comprises recording a vertical position of the track after a lifting and tamping procedure, and using a control device to activate the clearing devices upon exceeding a prescribed vertical position.

* * * * *